United States Patent [19]

Ono

[11] Patent Number: 4,986,349

[45] Date of Patent: Jan. 22, 1991

[54] HEAT EXCHANGER

[75] Inventor: Takuro Ono, Chiryu, Japan

[73] Assignee: Aisin Seiki Kabushiki Kaisha, Kariya, Japan

[21] Appl. No.: 500,104

[22] Filed: Mar. 27, 1990

Related U.S. Application Data

[63] Continuation of Ser. No. 248,926, Sep. 26, 1988, abandoned.

[30] Foreign Application Priority Data

Sep. 30, 1987 [JP] Japan ..... 62-148210[U]

[51] Int. Cl.[5] ..... F28D 7/10

[52] U.S. Cl. ..... 165/154; 165/183

[58] Field of Search ..... 165/154, 183

[56] References Cited

U.S. PATENT DOCUMENTS

| | | | |
|---|---|---|---|
| 2,179,721 | 11/1939 | Hock et al. | 165/154 X |
| 3,036,818 | 5/1962 | Legrand | 165/154 |
| 4,059,882 | 11/1977 | Wunder | 29/157.3 A |
| 4,096,910 | 6/1978 | Coffinberry et al. | 165/81 |
| 4,368,777 | 1/1983 | Grasso | 165/154 |

FOREIGN PATENT DOCUMENTS

| | | | |
|---|---|---|---|
| 2545594 | 11/1984 | France | 165/154 |
| 59-49447 | 3/1984 | Japan . | |
| 59-225294 | 12/1984 | Japan . | |

*Primary Examiner*—Martin P. Schwadron
*Assistant Examiner*—Allen J. Flanigan
*Attorney, Agent, or Firm*—Burns, Doane, Swecker & Mathis

[57] ABSTRACT

A heat exchanger includes a cylindrical main body formed by extrusion molding having a first connection with a first inlet for cooling water and a first outlet for high temperature fluid and connected to one end of the main body and a second connection with a second inlet for the high temperature fluid and a second outlet for the cooling water. A cooling water passage is provided in the cylindrical main body and extends axially thereof. The cooling water passage is connected to the first inlet and the second outlet for the cooling water. The heat exchanger also includes a high temperature fluid passage in the main body extending along with the cooling water passage. The high temperature fluid passage is connected to the first outlet and the second inlet for the high temperature fluid and fins are connected to the high temperature fluid passage for heat exchanging.

3 Claims, 3 Drawing Sheets

HEAT EXCHANGER

This application is a continuation of application Ser. No. 07/248,926, filed Sept. 26, 1988 now abandoned.

BACKGROUND OF THE INVENTION

1. Field of the Invention

The present invention relates to a heat exchanger used for retrieving heat energy from a high temperature fluid, such as waste gas discharged from an internal combustion engine.

2. Description of the Prior Art

An example of a heat exchanger for retreiving heat energy from a high temperature fluid is shown in Japanese patent publication number 59-225294 dated Dec. 18, 1984. Therein the heat exchanger includes a header, water jacket and heat conductive tubes all being separately made and thereafter assembled. Thus, it includes many connecting portions which must be sealed by the use of gaskets or by brazing so as to prevent fluid leakage.

Another example of prior art is shown in Japanese patent publication number 59-49447 dated Mar. 22, 1984. The heat exchanger is formed by use of a complex shape casting. During such manufacturing, gas may be generated which. penetrates the wall of the heat exchanger and causes pin holes. This may lead to a fluid leakage through the pin holes.

SUMMARY OF THE INVENTION

It is an object of the present invention to provide an improved heat exchanger which can obviate the foregoing drawbacks.

It is another object of the present invention to provide an improved heat exchanger which is compact, light-weight and easily manufactured.

It is a further object of the present invention to provide an improved heat exchanger which will decrease the incidents of fluid leakage and accidents caused thereby.

It is still further object of the present invention to provide an improved heat exchanger which obviates drawbacks of conventional systems and which includes a cylindrical main body formed by extrusion molding, a first connection having a first inlet for cooling water and a first outlet for high temperature fluid and connected to one end of the main body. A second connection is provided which has a second inlet for the high temperature fluid and a second outlet for the cooling water. A cooling water passage is disposed or positioned in the cylindrical main body and extends axially therewith. The cooling water passage is connected to the first inlet and the second outlet for the cooling water. A high temperature fluid passage is disposed or positioned in the main body and extends along with the cooling water passage. The high temperature fluid passage is connected to the first outlet and the second inlet for the high temperature fluid and a fin sYstem is connected to the high temperature fluid passage to permit the exchange of heat.

BRIEF DESCRIPTION OF THE DRAWINGS

Various other objects, features and attendant advantages of the present invention will be more fully appreciated as the same becomes better understood from the following detailed description when considered in connection with accompanying drawings.

DETAILED DESCRIPTION OF AN EMBODIMENT OF THE INVENTION

Figure 1:
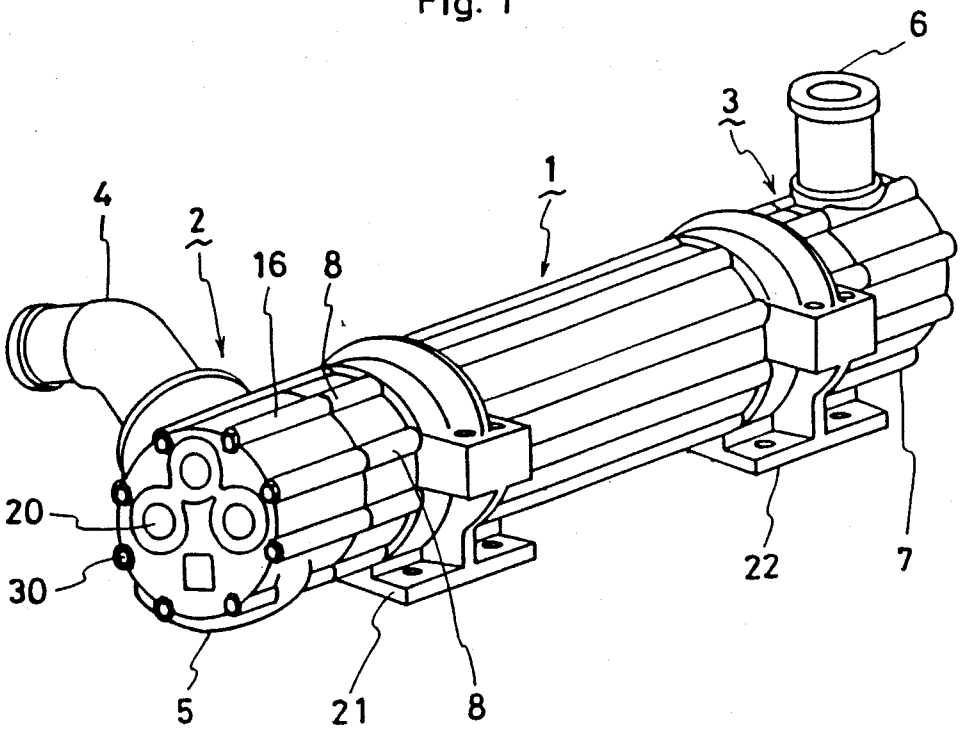
FIG. 1 shows a perspective view of the heat exchanger according to the present invention.

Referring now to the drawings, a heat exchanger for receiving engine exhaust gas is disclosed in which a main body 1 of the heat exchanger is made of aluminum and is formed by extrusion molding. The outer periphery of the main body 1 is approximately of columnar shape. A first connection 2 is connected to one end of the main body 1 and is formed by aluminum casting. The first connection has an inlet 4 for cooling water and an outlet 5 for discharged gas.

Similarly, at the other end of the main body 1 is connected a second connection 3 also formed by aluminum extrusion and having a cooling water outlet 6 and a discharge gas inlet 7.

Figure 2:
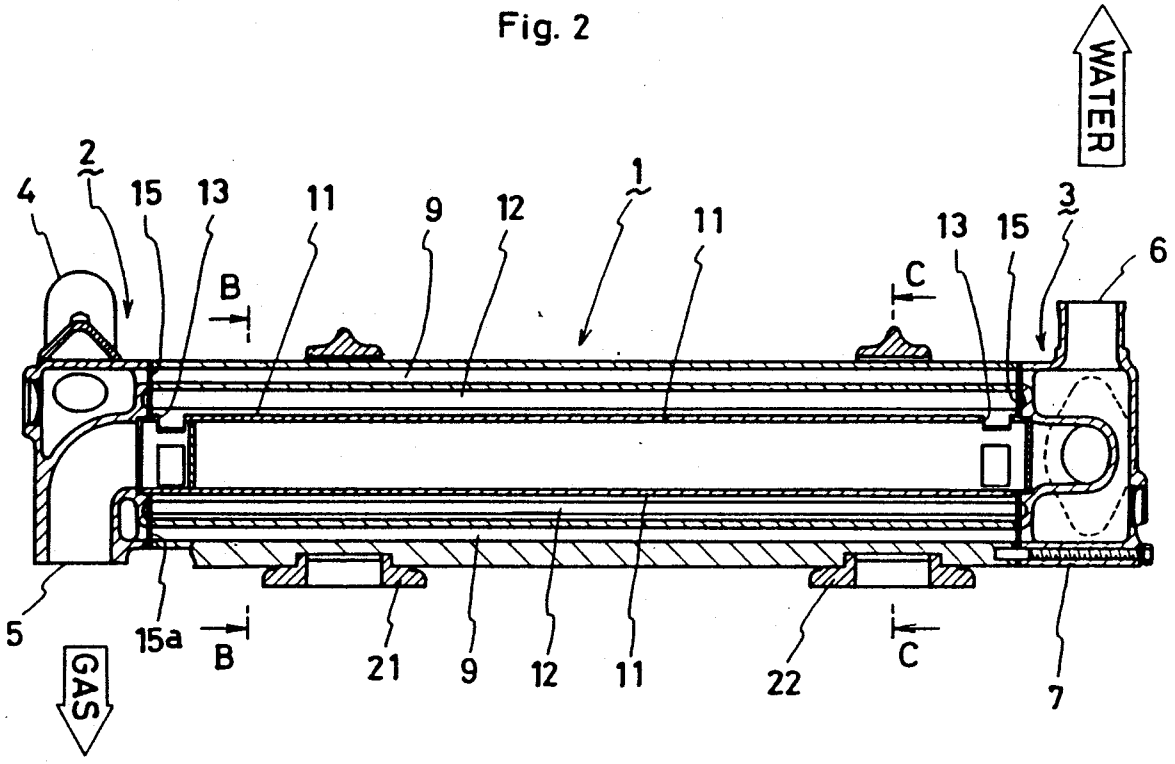
FIG. 2 shows a cross-sectional view of the embodiment of FIG. 1.
Figure 3:
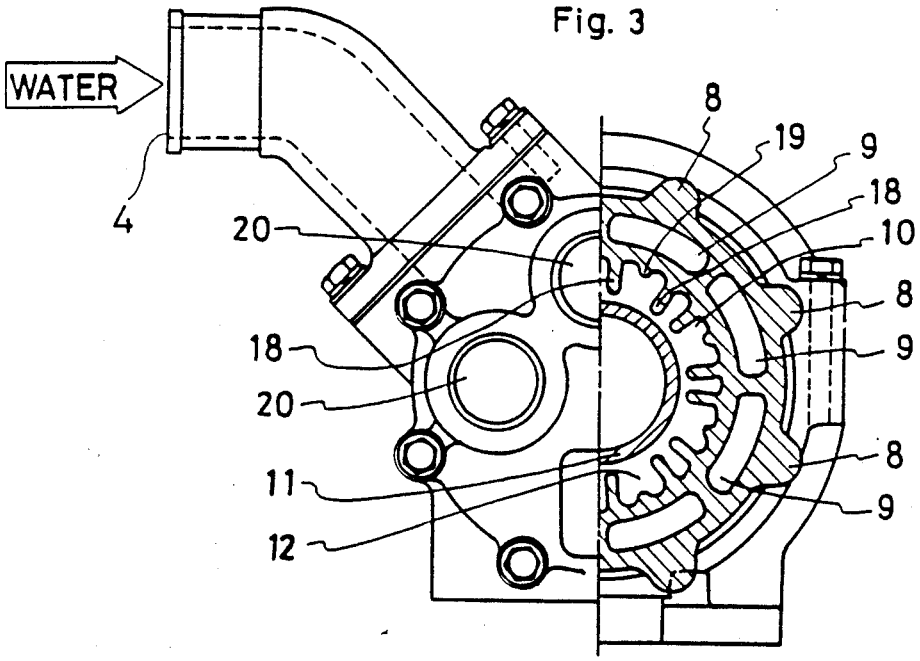
FIG. 3 shows a partial cross-sectional view taken along the line B—B of FIG. 2.
Figure 4:
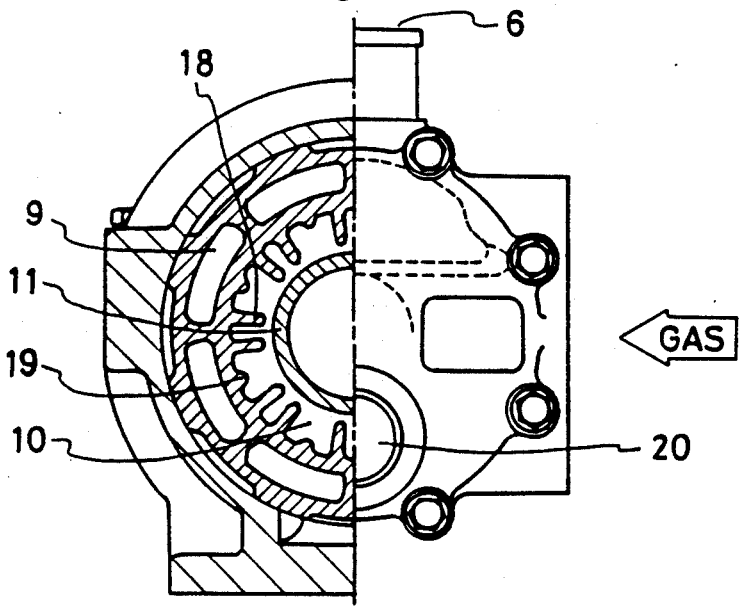
FIG. 4 shows a partial cross-sectional view taken along the line C—C of FIG. 3.

As is shown in FIGS. 2–4, the main body 1 has a plurality of projections 8 formed on the entire outer periphery of the main body 1 with equal intervals between one another. Inside the main body 1, a plurality of passages 9 are provided for cooling water. Each passage being in parallel with one another and extending in an axial direction on the same circular line. Inside of each passage 9 a plurality fins 10 are integrally formed.

In a central portion of the main body 1, a hollow cylindrical portion 11 is provided which is formed substantially concentric with and radially to of the fins 10. A passage 12 for a discharge gas is formed coaxially with the passages 9 for the cooling water and between the outer periphery of the hollow cylindrical portion 11 and the fins 10 (FIG. 3). Openings 13 are formed at both end portions of the cylindrical portion 11 for connection with the passage 12. The first connection 2 is attached to the main body 1 by a plurality of bolts 30 which are inserted into projections 16 on the outer periphery of the first connection 2 and which are coaxially formed to permit attachment with the projections 8 formed on the main body 1, as is clearly shown in FIG. 1. It can be seen from FIG. 2 that the inner faces of the first and second connections 2, 3 have recesses formed therein for seating the ends of the cylindrical portion 11.

Gaskets 15 are provided between the projections 8 and 16 and having openings **15*a* which communicate with the cooling water passages 9 for establishing communication between the passages and the inlet 4 for the cooling water. The second connection 3 has a connection similar to that of the first connection 2 and is connected to the other end of the main body 1. The cooling water from the inlet 4 is discharged through passages 9, openings 15*a* of the gaskets 15 and the outlet 6, while the discharge gas from the engine (not shown) is introduced into the inlet 7 of the second connection 3, discharge gas passage 12 in the main body 1, opening 13 of the cylindrical portion 11 and the outlet 5. As described, the discharged gas passage 12 is provided with fins 10 for increasing the contact area of the gas passing therethrough. The fins 10 have longer projections 18 and shorter projections 19 as shown in FIG. 3. The shorter projections 19 also serve for absorbing the tolerances which occur during aluminum extrusion molding. The numeral 20** designates plugs which are inserted into openings provided for removal of the cores.

Numerals 21 and 22 designate attachment flanges for a gas heat pump engine which will retrieve the heat of the engine exhaust gas to the cooling water thereby increase the heating capacity of the heat pump.

The sealing arrangement for the heat exchanger is provided by the gaskets 15 in the axial direction. As the main body 1 and two connections 2 and 3 have same heat expansion rate, the axial expansion of the assembly due to heat will not effect the sealing arrangement between the connecting portions.

When the main body and the two connections are expanded in radial direction due to heat, such radial expansion is of a smaller degree than axial expansion. Therefore, the exchanger will not be subjected to material damages.

Since the main body and two the connections are formed by extrusion molding, there will be no internal cavities in the body of the molding and since the two connections 2 and 3 are formed by aluminum extrusion and the size in axial direction is relatively small, the gas formed during the manufacturing of the exchanger may easily be removed to avoid any pin holes which may otherwise cause leakage problems.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A heat exchanger comprising:

a cylindrical main body formed by extrusion molding;

a first connection having a first inlet for cooling water and a first outlet for high temperature fluid and connected to one end of the main body;

a second connection having a second inlet for the high temperature fluid and a second outlet for the cooling water and connected to an opposite end of the main body;

a plurality of cooling water passages formed in one piece with and as an integral part of the cylindrical main body, each of said cooling water passages extending axially along the main body and being connecting to the first inlet and the second outlet for the cooling water;

a high temperature fluid passage formed in the main body and positioned radially inwardly of said plurality of cooling water passages, said high temperature fluid passage extending axially along the main body and being connected to the first outlet and the second inlet for the high temperature fluid;

fin means for exchanging heat, said fin means being formed integrally and in one piece with said main body and said fin means extending into said high temperature fluid passage;

a first unitary sealing gasket axially compressed between and separate from the first connection and axially facing seal faces surrounding the cooling water passage and the high temperature fluid passage at the one end of the main body, the first gasket having an opening connecting the first inlet for the cooling water with the cooling water passage; and a second unitary sealing gasket axially compressed between and separate from the second connection and axially facing seal faces surrounding the cooling water passage and the high temperature fluid passage at the opposite end of the main body, the second gasket having an opening connecting the second outlet for the cooling water with the cooling water passage.

2. A heat exchanger comprising:

a cylindrical main body formed by extrusion molding, said cylindrical main body including a substantially centrally located cylindrical hollow portion;

a first connection connected to one end of the main body, said first connection having a first inlet for cooling water, a first outlet for high temperature fluid, and a recess formed in an inner face thereof, one end of said cylindrical hollow portion being located in said recess in said first connection;

a second connection connected to an opposite end of the main body, said second connection having a second inlet for the high temperature fluid, a second outlet for the cooling water, and a recess formed in an inner face thereof, an opposite end of said cylindrical hollow portion being located in said recess in said second connection;

a plurality of cooling water passages formed in one piece with and as an integral part of the cylindrical main body, each of said cooling water passages extending axially along the main body and being connected to the first inlet and the second outlet for the cooling water;

a high temperature fluid passage formed in the main body and positioned radially inwardly of said plurality of cooling water passages, said high temperature fluid passage extending substantially coaxially with respect to said cooling water passages;

at least one opening extending through a wall of the cylindrical hollow portion at the one end thereof for communicating the first outlet with the high temperature fluid passage;

at least one opening extending through the wall of the cylindrical hollow portion at the opposite end thereof for communicating the second inlet with the high temperature fluid passage;

fin means for exchanging heat, said fin means being formed integrally and in one piece with said main body and said fin means extending into said high temperature fluid passage;

a first unitary sealing gasket axially compressed between and separate from the first connection and axially facing seal faces surrounding the cooling water passage and the high temperature fluid passage at the one end of the main body, the first gasket having an opening connecting the first inlet for the cooling water with the cooling water passage; and a second unitary sealing gasket axially compressed between and separate from the second connection and axially facing seal faces surrounding the cooling water passage and the high temperature fluid passage at the opposite end of the main body, the second gasket having an opening connecting the second outlet for the cooling water with the cooling water passage.

3. The heat exchanger according to claim 2, including a plurality of openings extending through the wall of the cylindrical portion at the one end and at the opposite end thereof, said plurality of openings being spaced apart around the circumference of the cylindrical hollow portion at respective ends thereof.

* * * * *